US005860570A

United States Patent [19]

Ilksoy

[11] Patent Number: 5,860,570

[45] Date of Patent: Jan. 19, 1999

[54] DRUM HOLD-DOWN APPARATUS

[75] Inventor: Erhan Ilksoy, Roswell, Ga.

[73] Assignee: Nordson Corporation, Westlake, Ohio

[21] Appl. No.: 833,939

[22] Filed: Apr. 14, 1997

[51] Int. Cl.[6] ..... B67D 5/06

[52] U.S. Cl. ..... 222/146.5; 222/184; 222/405; 269/91; 269/160

[58] Field of Search ..... 222/146.2, 146.5, 222/173, 184, 380, 405; 269/91, 104, 153, 160, 176

[56] References Cited

U.S. PATENT DOCUMENTS

| | | | |
|---|---|---|---|
| 268,416 | 12/1882 | Churn . | |
| 1,058,223 | 4/1913 | Dosch | 269/176 |
| 2,550,019 | 4/1951 | Murphy | 248/311 |
| 3,091,342 | 5/1963 | Crump | 211/71 |
| 3,637,111 | 1/1972 | McCreary | 222/146 |
| 4,195,755 | 4/1980 | Slautterback et al. | 222/146.5 |
| 4,592,491 | 6/1986 | Chollet | 222/146.5 |
| 4,632,277 | 12/1986 | Pallante | 222/146.2 |
| 4,790,458 | 12/1988 | Moore | 222/146.5 |
| 4,991,279 | 2/1991 | Gaskell | 269/91 |
| 5,009,565 | 4/1991 | Esau | 414/607 |
| 5,078,304 | 1/1992 | Schneider | 222/405 |
| 5,366,339 | 11/1994 | Gould | 414/607 |

FOREIGN PATENT DOCUMENTS

| | | |
|---|---|---|
| 8316833.8 | 9/1983 | Germany . |
| 9007347.9 | 2/1991 | Germany . |

*Primary Examiner*—Joseph A. Kaufman
*Attorney, Agent, or Firm*—Wood, Herron & Evans, L.L.P.

[57] ABSTRACT

An apparatus (10) for holding down a drum (16) includes a base plate (42), a pair of mounting plates (60) fixedly secured to the base plate (42) located on opposite sides of the base plate (42), and a pair of hold-down plates (52,54). Each of the hold-down plates (52,54) are movably mounted upon one of the mounting plates (60). Each of the hold-down plates (52,54) is engageable with a peripheral surface (90) of the drum (16) resting on the base plate (42) to center the drum (16) relative to the apparatus (10). Each of the hold-down plates (52,54) also has a tapered leading edge (74) engageable with the drum (16) as the drum is inserted between the mounting plates (60). The apparatus (10) also includes a pair of cantilever extensions (100,102) fixedly attached to each of the mounting plates (60) that extend inwardly toward the drum (16).

20 Claims, 6 Drawing Sheets

DRUM HOLD-DOWN APPARATUS

BACKGROUND OF THE INVENTION

1. Field of Invention

This invention pertains to the art of apparatuses for holding down containers or drums, and more specifically to an apparatus mounted on the top side of a base plate and engageable with a drum supported upon the base plate to hold down the drum while a platen assembly, for pumping molten thermoplastic material, is removed from the drum.

2. Description of the Related Art

It is known in the art to use various apparatuses to hold down a drum while a platen assembly is removed from the drum. Some of these apparatuses consisted of a pair of hold-down plates or pins. The hold-down plates were attached by a mechanism which included bolts sliding against springs which were attached to mounting plates which in turn were mounted to a base plate secured to the ground. The drum was placed between the hold-down plates and the lower surfaces of the hold-down plates engaged the flange that circled the bottom of the drum. The hold-down plates prevented the drum from being lifted along with the platen assembly while the platen assembly was being removed from the drum. However, this type apparatus had deficiencies. The force applied to the hold-down plates by the drum flange as the platen assembly was being lifted often caused the hold-down plates to be displaced from their proper position. The tendency of the hold-down plates to be displaced was exacerbated by the wearing of slots through which the bolts would slide. When the hold-down plates were displaced, they could puncture the base of the drum, thereby releasing the vacuum being created inside the drum due to the removal of the platen assembly. Puncturing the drum prevents it from being reused and causes it to be scrapped.

Applicant recognized a need to improve the existing hold-down mechanism to prevent the hold-down plates from being displaced and damaging the drum. Applicant also recognized the need to develop a hold-down mechanism which would not damage the platen seals during inadvertent or accidental downward movement of the platen assembly when a drum was not mounted under the assembly and on the hold-down plates. To that end, a chamfer has been included on the hold-down mechanism to provide a smooth transition for the platen seals as the platen assembly is lowered past the hold-down mechanism.

The present invention contemplates a new and improved hold-down mechanism for use with an apparatus for melting and dispensing solid thermoplastic material directly from a drum. The invention is simple in design, effective in use, and overcomes the foregoing difficulties and others while providing better and more advantageous overall results.

SUMMARY OF THE INVENTION

In accordance with the present invention, a new and improved hold-down mechanism for use with an apparatus for melting and dispensing solid thermoplastic material from a drum is provided. The inventive apparatus has features which prevent the components of the hold-down mechanism from puncturing the drum or damaging the drum sidewalls.

More particularly, in accordance with the present invention, an apparatus for holding down a drum includes a base plate, a pair of mounting plates fixedly secured to the base plate located on opposite sides of the base plate, and a pair of hold-down plates movably mounted upon the mounting plates. Each of the hold-down plates is engageable with a peripheral surface of the drum resting atop the base plate. Each of the hold-down plates has a leading edge engageable with the drum as the drum is inserted between the mounting plates. The apparatus also includes a pair of cantilever extensions fixedly attached to each of the mounting plates and that extend inwardly toward the drum.

According to one aspect of the invention, the apparatus for melting and dispensing solid thermoplastic material includes a base plate and a platen assembly mounted above the base plate. The platen assembly includes a heated platen located beneath a follower plate. The platen assembly also includes a pump for pumping heated thermoplastic material from the underside of the follower. A motor means is provided to move the platen assembly downwardly into and upwardly out of the drum resting upon the top of the base plate.

The apparatus also includes a drum hold-down mechanism for preventing the drum from lifting from the base plate upon removal of the platen assembly from the drum. The hold-down mechanism includes a pair of mounting plates fixedly secured to the base plate located on opposite sides of the base plate and a hold-down plate movably mounted upon each of the mounting plates. The hold-down apparatus further includes a spring coupling apparatus operable between each of the mounting plates and hold-down plates for biasing the hold-down plates inwardly toward one another. Each of the hold-down plates has a generally V-shaped recess formed thereon and is engageable with the peripheral surface of a drum resting atop the base plate. Each of the hold-down plates also has a leading edge engageable with a drum as a drum is inserted between the mounting plates. The leading edges of the hold-down plates are operable as cam surfaces to force the hold-down plates apart as the drum is inserted therebetween. The hold-down mechanism also includes a pair of cantilever extensions fixedly attached to each of the mounting plates and that extend inwardly toward the drum.

According to another aspect of the present invention, an apparatus for holding down a drum includes a pair of mounting plates on opposite sides of the drum, a pair of hold-down plates movably mounted upon the mounting plates, and a cantilever extension fixedly attached to each of the mounting plates that extends inwardly toward the drum.

One advantage of the present invention is that the cantilever extensions prevent the hold-down plates from being displaced, thereby reducing the likelihood of the drum from being punctured by the hold-down plates.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and herein.

DESCRIPTION OF THE PREFERRED EMBODIMENT

Figure 1:
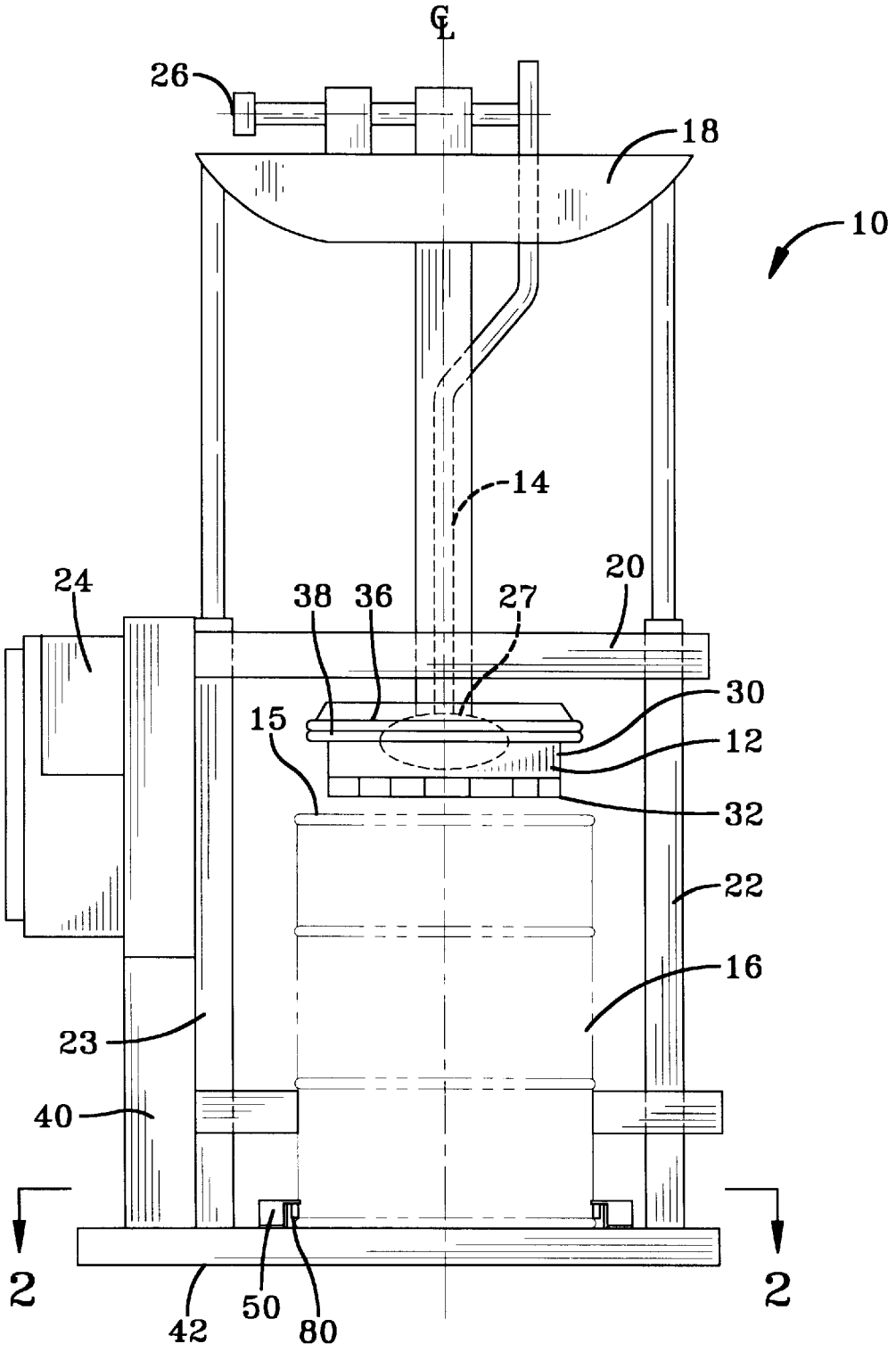
FIG. 1 is a front elevational view of a bulk melting and dispensing apparatus for removing material from a drum.

Referring now to the drawings wherein the showings are for purposes of illustrating a preferred embodiment of the invention only and not for purposes of limiting the same, FIG. 1 shows a front or side view of a melting and dispensing apparatus 10 which includes a platen assembly 12 mounted on a central support tube 14 for insertion into the open top 15 of a drum 16 containing a thermoplastic material. While the invention will be described with respect to a drum 16, the invention is applicable to many other kinds of containers. The support tube 14 is carried by a frame member 18 for reciprocal movement into and out of the drum 16. Air cylinders 22,23 located on opposite sides of the drum 16 effect vertical reciprocation of the frame member 18 and hence the reciprocation of the support tube 14 and the platen assembly 12. Control apparatus enclosure 24 contains the necessary electrical and air controls for the apparatus 10. A motor 26 drives a pump 27 (schematically illustrated in FIG. 1) located in the platen assembly 12. The platen assembly 12 includes a follower plate 30 and a heated platen 32 mounted beneath the follower plate 30. In the preferred embodiment, the follower plate 30 and the heated platen 32 are an integral piece. The platen assembly 12 also includes two seals 36,38 for providing an air-tight seal between the platen assembly 12 and the walls of the drum 16.

The apparatus 10 also includes a frame 40 in addition to frame member 18. The frame 40 has a second frame member 20 and a base plate 42. The exact arrangement of the apparatus 10 may vary. The present invention may be used with any apparatus in which a platen assembly 12 is inserted into a drum 16 to pump out material, and then is removed. A more complete description of the typical operation and objectives of one such apparatus 10 may be found in U.S. Pat. No. 4,632,277 to Pallante, which has a common assignee with this application, and which is hereby incorporated by reference.

Figure 2:
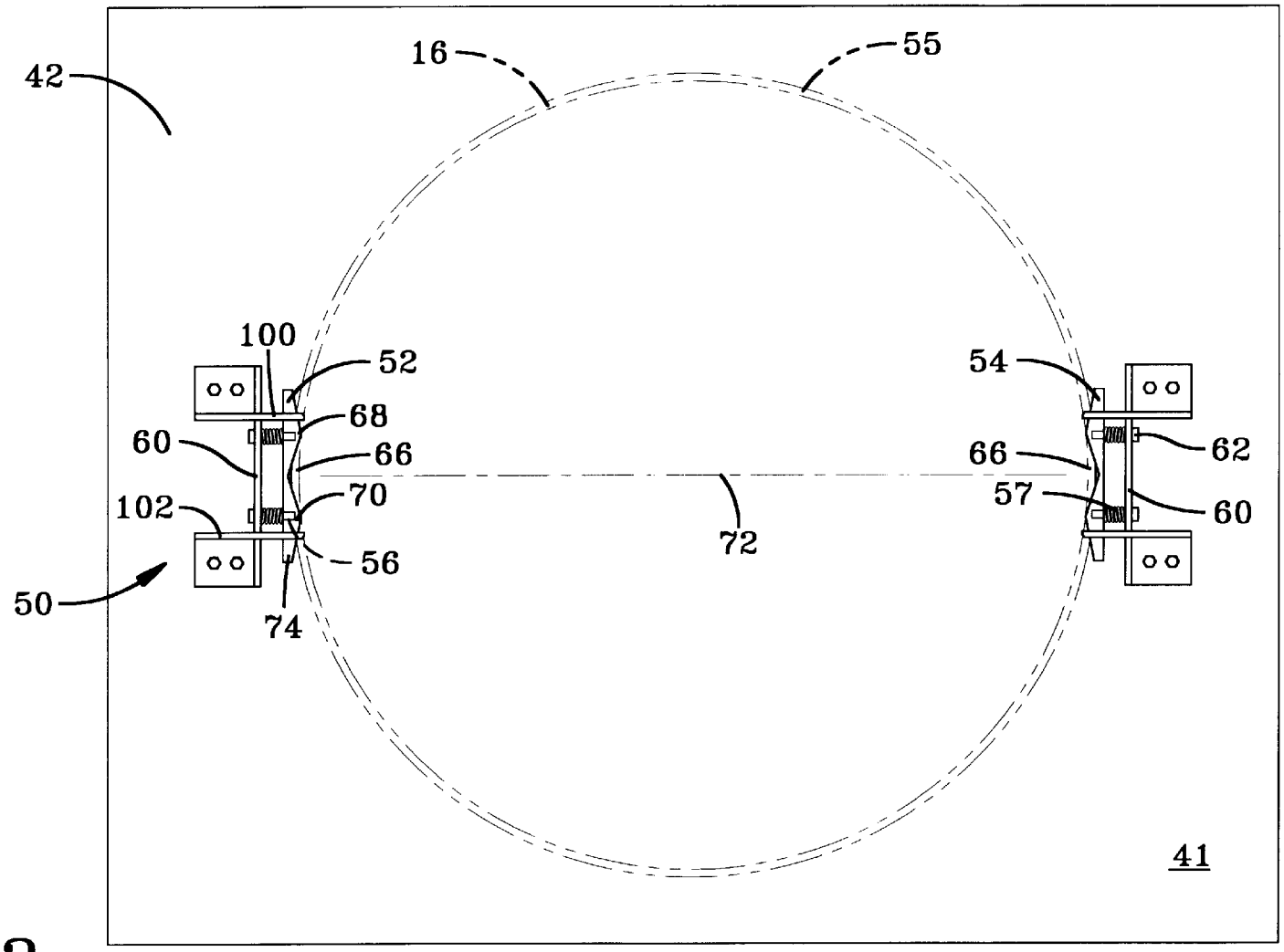
FIG. 2 is a cross-sectional view taken along line 2—2 of FIG. 1.
Figure 3:
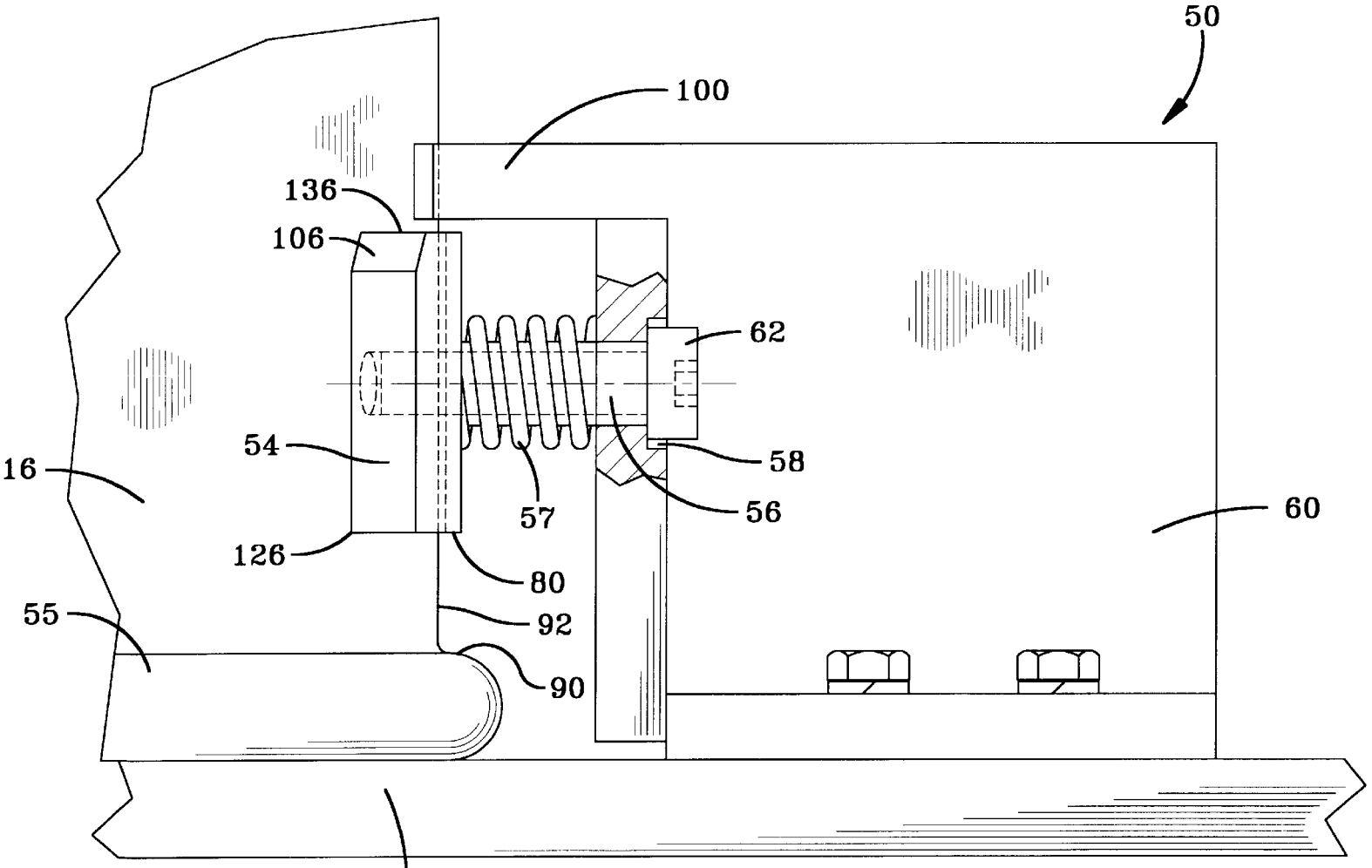
FIG. 3 is a side view of a hold-down mechanism according to one embodiment of the invention.
Figure 4:
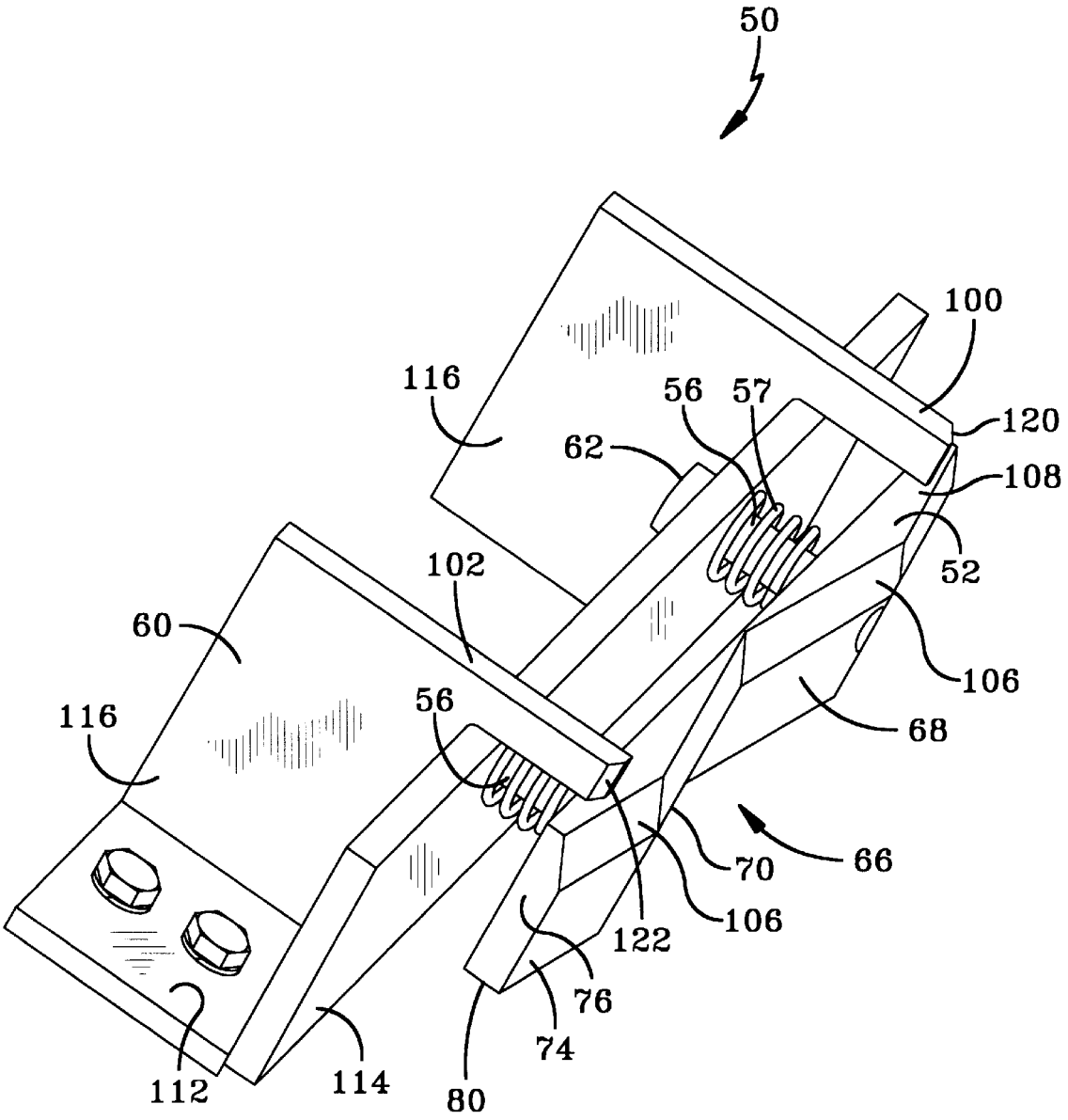
FIG. 4 is a perspective view of the mounting plate of FIG. 3.
Figure 6:
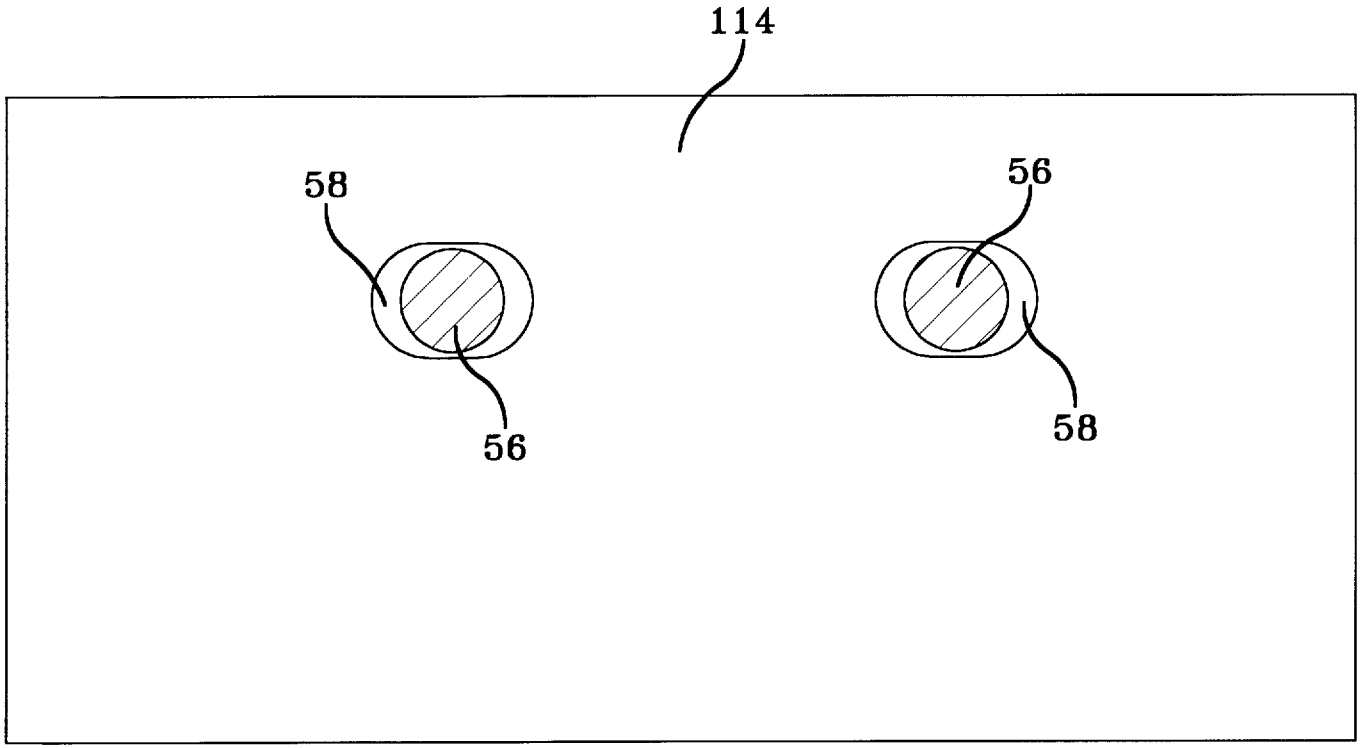
FIG. 6 is a front view of the vertical wall of a mounting plate.

With reference to FIGS. 1–4, FIG. 2 is a cross-sectional view of a drum hold-down mechanism 50 mounted on the base plate 42. The drum hold-down mechanism 50 includes a pair of drum hold-down plates 52,54 which are located on and engageable with opposite sides of the drum 16 above a lower flange 55 of the drum 16. Each of these hold-down plates 52,54 carries a pair of supporting pins 56 which extend through holes 58 in one of a pair of mounting plates or mounting plate assemblies 60. As is best illustrated in FIG. 6, each of the holes 58 is slotted, preferably elliptically, to allow the support pins 56 to slide within the holes 58 in the plane of a vertical wall 114 of the mounting plates 60. The mounting plates 60 are in turn bolted or otherwise fixedly secured to the top surface 41 of the base plate 42. Each supporting pin 56 is provided with an enlarged head 62 which prevents the pins 56 from passing through and out of the holes 58 in the mounting plates 60. In the preferred embodiment the enlarged heads 62 are round but they can be of other configurations, such as elliptical. As best illustrated by FIG. 4, each of the mounting plates 60 preferably includes a base 112, the vertical wall 114, and support arms 116.

A compression spring 57 surrounds and is coaxial with each of the pins 56 and is located between the hold-down plates 52,54 and the mounting plates 60. The compression springs 57 bias the hold-down plates inwardly toward the vertical centerline CL of the drum 16 supported atop the base plate 42 for engagement with the drum 16.

Cantilever extensions 100,102 extend toward the drum 16 from each of the mounting plates 60 and over top of the hold-down plates 52,54. The cantilever extensions 100,102 prevent the hold-down plates 52,54 from being displaced due to force generated by movement of the drum 16 and the drum flange 55 as the platen assembly 12 is removed from the drum 16. Due in part to seals 36,38 as the platen assembly 12 begins to withdraw from the drum 16, a vacuum is generated within the drum 16. The vacuum so created tends to pull upwardly on the drum 16, tending to displace the drum 16 upwardly along with the upwardly moving platen assembly 12. In the past, this upward movement created an upward force on the hold-down plates causing them to pivot and possibly puncture the drum. The cantilever extensions prevent the hold-down plates from pivoting, thereby preventing the drum from being punctured.

As is best illustrated in FIG. 4, the preferred embodiment of the inventive hold-down mechanism 50 includes first and second cantilever extensions 100,102 for each mounting plate 60. The cantilever extensions 100,102 balance out the load and tend to support and strengthen the mounting plates 60. Although the preferred embodiment includes two cantilevers, other embodiments of the invention may employ other numbers of cantilever extensions, or one such extension, or may use extensions which are not cantilevered but are supported another way.

Figure 5:
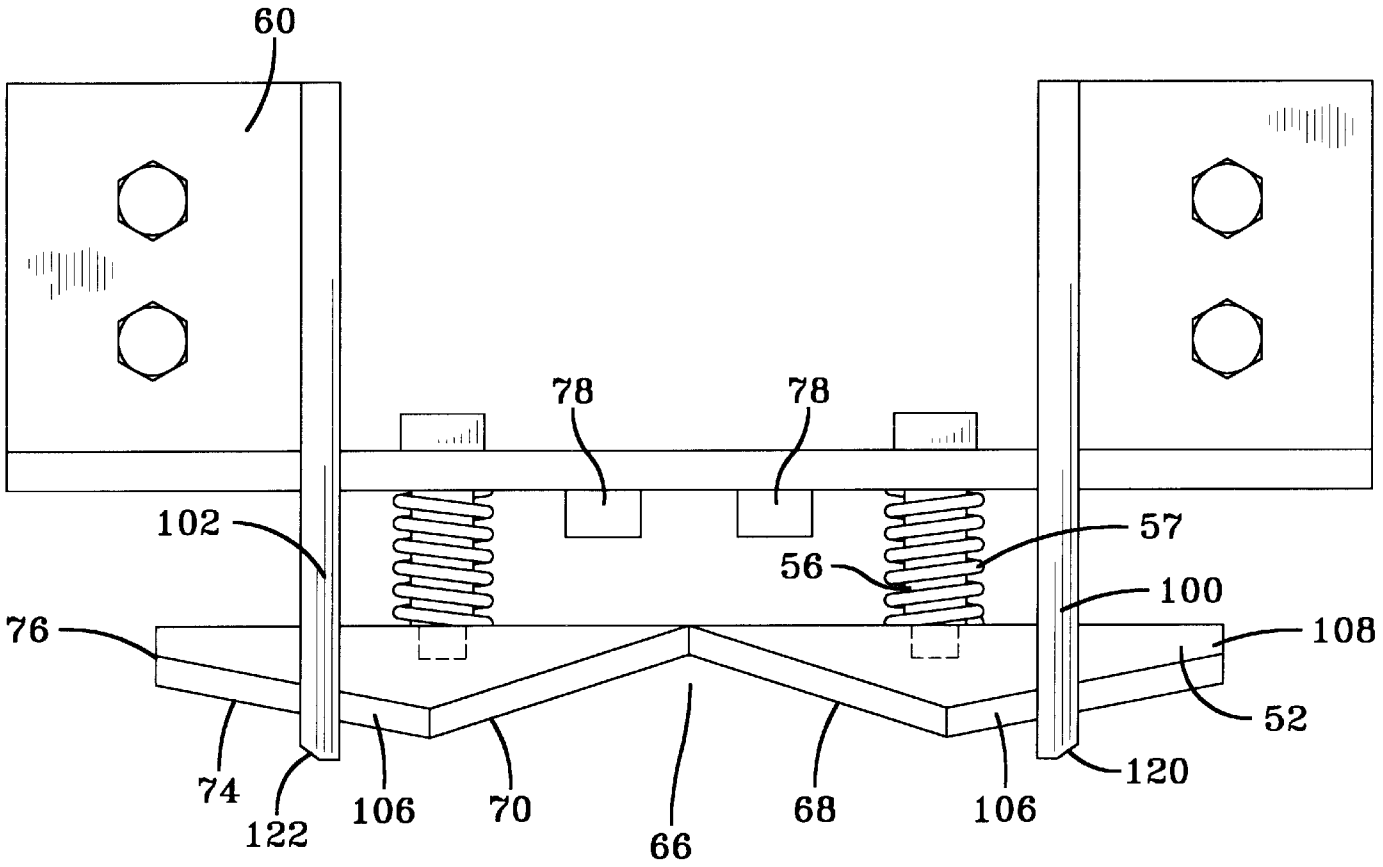
FIG. 5 is an enlarged top view of the inventive hold-down mechanism.

With reference to FIGS. 2 and 5, it is preferred that each hold-down plate 52,54 is configured to include a valley 66 situated between two peaks 68,70. The peaks 68,70 engage the peripheral surface of the drum 16 on opposite sides of a diametrical center plane 72 of the drum 16 when the drum 16 is supported on the base plate 42. The configuration of the hold-down plates 52,54 is preferably "V-shaped" as viewed from the top, or it can be said that the hold-down plates 52,54 have a "V-shaped" recess, however the hold-down plates 52,54 may also be of other configurations. Similarly, even the peaks 68,70 and valley 66 of the preferred hold-down plates 52,54 may also be of other configurations. For example, the configuration of the hold-down plates 52,54 may be generally semi-circularly shaped to conform to the peripheral surface of the drum 16. Of course, if the container or drum in question has a different shape, the configuration of the hold-down plates could be made to correspond thereto.

With reference to FIG. 5, stops 78 are preferably mounted between the hold-down plate 52,54 and mounting plate 60 to prevent deformation of the pins 56, to limit the movement of the hold-down plate 52, and to restrict the compression of the compression springs 57.

Each hold-down plate 52,54 preferably has a tapered leading edge surface 74 which is tapered in the horizontal direction and which is engageable with the peripheral surface 92 of the drum 16. The tapered leading edge surfaces 74 primarily help in the receiving of the drum 16. As the drum 16 is operatively engaged by each tapered leading edge surface 74, it forces the hold-down plates 52,54 diametrically away from one another, pushing against the bias of the springs 57. When the drum 16 assumes a centered position between the plates 52,54 and beneath the platen assembly 12, the peaks 68,70 of each hold-down plate 52,54 are engaged with the peripheral surface 90 of the drum 16 on opposite sides of the drum 16.

With reference to FIGS. 4 and 5, each of the hold-down plates 52,54 may include a top chamfer 106 along the upper edge 108 of the hold-down plates 52,54. In the event that the platen assembly 12 is lowered without a drum 16 in place, the top chamfer 106 provides a tapered surface that contacts the seals 36,38, thereby providing a smooth transition between the seals 36,38 and the hold-down plates 52,54. The hold-down plates 52,54 are then pushed apart one from the another. Without the top chamfer 106, the seals 36,38 may be damaged by the upper edge 108 of each of the hold-down plates 52,54.

The cantilever extensions 100,102 may also include vertical side chamfers 120,122 to engage the drum 16 being inserted into the melting and dispensing apparatus 10. The vertical side chamfers 120,122 help ensure that the drum 16 will not be pierced by a sharp corner edge on the cantilever extensions 100,102. Rather, the vertical side chamfers 120, 122 engage the drum 16 and provide a smooth transition as the drum 16 is inserted.

The mounting plates 60 in combination with the hold-down plates 52,54 and peripheral edge 90 may be secured directly to a stationary reference point, such as a factory floor, without the need for a base plate 42.

With reference to FIGS. 3 and 4, the problem solved by the invention will now be described. After the associated drum 16 has been emptied of its contents, such as a thermoplastic material, the platen assembly 12 (as illustrated in FIG. 1) is lifted from the drum 16. Due to the vacuum created by seals 36,38, the drum 16 tends to be lifted by the vacuum generated by the lifting of the platen assembly 12 from the drum 16. In the case of the prior art, before the invention of the applicants, upward movement of the drum 16 caused the peripheral edge 90 of the drum to contact the lower edges 80 of the hold-down plates 52,54. As the drum 16 continued to move upwardly, the peripheral edge 90 pushed against the lower edge 80 until hold-down plates 52,54 began to pivot about a horizontal axis in the plane of vertical plate 114 and perpendicular to a centerline CL of the pins 56. Such rotation caused an inward lower edge 126 to press radially inwardly toward the interior of the drum 16, in some cases piercing the drum. The piercing of the drum 16 prevents the drum from being reused and causes it to be scrapped. The destruction of the drum represents the loss of a useful tool, the incurrence of an unnecessary expense in disposing of the drum, and an unnecessary waste of natural resources.

With continued reference to FIGS. 3 and 4, the operation of the applicant's invention will now be described. The drum 16 tends to move upwardly as the platen assembly 12 is lifted from the drum 16. As described above, the top surface 90 of the peripheral edge 90 of the flange 55 of the bottom of the drum 16 contacts the lower surface 80 of the hold-down plates 52,54. Again, the force exerted on the lower surface 80 of the hold-down plates 52,54 tends to rotate the hold-down plates 52,54 about an axis in the plane of vertical wall 114 and perpendicular to both the centerline CL of the pin 56 and support arms 116. However, in the invention, the cantilever extensions 100,102 contact an upper surface 136 of the hold-down plates 52,54. The force exerted downwardly on the upper surface 136 of the hold-down plates 52,54 prevents the rotation of the hold-down plates 52,54 about the axis. Preventing this rotation keeps the lower surface 80 of the hold-down plates 52,54 in proper position against the top surface 90 of the flange 55 of the bottom of the drum 16. As the cantilever extensions 100,102 keep the hold-down plates 52,54 in proper relation against the upper surface 90 of the flange 55 on the bottom of the drum 16, the hold-down apparatus 50 withstands the upward forces generated by the removal of the platen assembly 12. Thus, the drum 16 is not pierced by the hold-down plates 52,54 and can be reused.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

I claim:

1. An apparatus for securing an associated drum in a location, comprising:

a base plate;

a first mounting plate fixedly secured to said base plate;

a first hold-down plate, said first hold-down plate being mounted to said first mounting plate by a coupling allowing movement in a first direction, said first hold-down plate being engageable with a peripheral surface of the associated drum; and, first securing means for securing said first hold-down plate in a desired position and resisting displacement of said first hold-down plate in a second direction while still allowing movement in said first direction, said first securing means being separate from the coupling and fixedly attached to said first mounting plate.

2. The apparatus of claim 1 wherein said first securing means comprises:

a first extension fixedly attached to said first mounting plate and extending inwardly toward said drum and over said first hold-down plate, said first extension preventing upward rotation of said first hold-down plate.

3. The apparatus of claim 2 wherein said apparatus further comprises:

a second mounting plate fixedly secured to said base plate;

a second hold-down plate, said second hold-down plate being movably mounted upon said second mounting plate, said second hold-down plate being engageable with a peripheral surface of the associated drum; and, second securing means for securing said second hold-down plate in a desired position and resisting displacement of said second hold-down plate; said second securing means being fixedly attached to said second mounting plate.

4. The apparatus of claim 3 wherein each of said first and second hold-down plates have a tapered leading edge engageable with said associated drum as said associated drum is inserted between said first and second mounting plates.

5. The apparatus of claim 3 wherein each of said hold-down plates are movably mounted upon one of said mounting plates by a pin, said pin being fixedly secured to one of said hold-down plates and inserted into a first hole in said mounting plate, the first hole being generally elliptically shaped.

6. The apparatus of claim 3 wherein each of said hold-down plates has a top edge and a bottom edge, said top edge of each of said hold-down plates being chamfered.

7. The apparatus of claim 3 further comprising:

first and second spring means, said first spring means mounted between said first mounting plate and said first hold-down plate and said second spring means mounted between said second mounting plate and said second hold-down plate for biasing said hold-down plates inwardly toward one another.

8. The apparatus of claim 1 wherein said first hold-down plate has a top edge and a bottom edge, said top edge of said first hold-down plate being chamfered.

9. An apparatus for melting and dispensing solid thermoplastic material, comprising:

a base plate;

a platen assembly mounted above said base plate, said platen assembly comprising a follower, a heating platen located beneath said follower, and a pump for pumping heated thermoplastic material from the underside of said follower;

motor means mounted upon said base plate and operable to move said platen assembly downwardly into and upwardly out of an associated drum resting upon the top of said base plate;

a drum hold-down mechanism for preventing said associated drum from lifting from said base plate upon removal of said platen assembly from said associated drum, said hold-down mechanism comprising:

a pair of mounting plates fixedly secured to said base plate, said mounting plates being located on opposite sides of said base plate;

a hold-down plate movably mounted upon each of said mounting plates, each of said hold-down plates being engageable with the peripheral surface of a drum resting atop said base plate to center said drum related to said hold-down mechanism; and, a pair of extensions fixedly attached to each of said mounting plates above said hold-down plates.

10. The apparatus of claim 9 further comprising:

each of said hold-down plates having a tapered leading edge engageable with the associated drum as the associated drum is inserted between said mounting plates, said tapered leading edges of said hold-down plates being operable as cam surfaces to force said hold-down plates apart as said drum is inserted therebetween.

11. The apparatus of claim 9 further comprising:

spring means operable between each of said mounting plates and hold-down plates for biasing said hold-down plates inwardly toward one another.

12. The apparatus of claim 9 wherein said pair of extensions are cantilevered.

13. The apparatus of claim 9 wherein each of said hold-down plates are movably mounted upon one of said mounting plates by a pin, said pin being fixedly secured to one of said hold-down plates and inserted into a first hole in said mounting plate, the first hole being generally elliptically shaped.

14. The apparatus of claim 9 wherein each of said hold-down plates has a top edge and a bottom edge, said top edge of each of said hold-down plates being chamfered.

15. An apparatus for holding down a drum, comprising:

a pair of mounting plates on opposite sides of said drum;

a pair of hold-down plates, each of said hold-down plates being movably mounted upon one of said mounting plates; and, an extension fixedly attached to each of said mounting plates above said pair of hold-down plates.

16. The apparatus of claim 15 further comprising:

a second extension fixedly attached to each of said mounting plates and above said hold-down plates.

17. The apparatus of claim 15 further comprising:

a base plate, said mounting plates being fixedly secured to said base plate on opposite sides of said base plate.

18. The apparatus of claim 15 wherein each of said hold-down plates are movably mounted upon one of said mounting plates by a pin, said pin being fixedly secured to one of said hold-down plates and inserted into a first hole in said mounting plate, the first hole being generally elliptically shaped.

19. The apparatus of claim 15 wherein each of said hold-down plates comprise a first and second pin, said first pin being received into the first hole in said mounting plate and the second pin being received into the second hole in said mounting plate, each of said first and second holes being elliptical in shape.

20. The apparatus of claim 15 wherein each of said hold-down plates having a top edge and a bottom edge, said top edge of each of said hold-down plates being chamfered.

* * * * *